US006880950B2

(12) United States Patent
Chan

(10) Patent No.: US 6,880,950 B2
(45) Date of Patent: Apr. 19, 2005

(54) FLASHLIGHT

(75) Inventor: Peter Chan, Kowloon (HK)

(73) Assignee: Lumilite International Ltd., Kowloon (HK)

( * ) Notice: Subject to any disclaimer, the term of this patent is extended or adjusted under 35 U.S.C. 154(b) by 0 days.

(21) Appl. No.: 10/245,341

(22) Filed: Sep. 18, 2002

(65) Prior Publication Data

US 2003/0165056 A1 Sep. 4, 2003

Related U.S. Application Data

(60) Provisional application No. 60/361,304, filed on Mar. 4, 2002.

(51) Int. Cl.[7] ..... F21L 4/04

(52) U.S. Cl. ..... 362/203; 362/199; 362/205; 362/184; 200/60

(58) Field of Search ..... 362/203, 199, 362/205, 184; 200/60

(56) References Cited

U.S. PATENT DOCUMENTS

| | | | | |
|---|---|---|---|---|
| 1,448,352 A | | 3/1923 | Barany et al. | |
| 1,455,938 A | | 5/1923 | Rode et al. | |
| 1,613,203 A | | 1/1927 | Shannon | |
| 2,221,126 A | | 11/1940 | Barbee | 240/10.66 |
| 2,245,707 A | | 6/1941 | Packer | 240/10.6 |
| 2,264,198 A | | 11/1941 | Chak | 240/10.66 |
| 2,312,844 A | | 3/1943 | Moxley | 240/10.63 |
| 2,330,673 A | | 9/1943 | Braum | 240/10.66 |
| 2,726,321 A | | 12/1955 | Riotto | 240/10.6 |
| 4,225,906 A | | 9/1980 | Gulliksen et al. | 362/254 |
| 4,249,234 A | * | 2/1981 | Park et al. | 362/228 |
| 4,386,391 A | | 5/1983 | Gulliksen et al. | 362/232 |
| 4,414,612 A | | 11/1983 | Conforti et al. | 362/188 |
| 4,533,984 A | | 8/1985 | Gatton | 362/232 |
| 4,788,633 A | | 11/1988 | Zimermann et al. | 362/296 |
| 4,803,605 A | | 2/1989 | Schaller et al. | 362/184 |
| 5,077,644 A | | 12/1991 | Schaller et al. | 362/184 |
| 5,367,446 A | | 11/1994 | Ellion | 362/184 |
| 5,384,693 A | | 1/1995 | Schwaller et al. | 362/72 |
| 5,558,430 A | | 9/1996 | Booty, Jr. | 362/184 |
| 5,629,105 A | | 5/1997 | Matthews | 429/97 |
| 5,871,272 A | | 2/1999 | Sharrah et al. | 362/184 |
| 5,876,110 A | * | 3/1999 | Uke | 362/184 |

* cited by examiner

*Primary Examiner*—Stephen Husar
*Assistant Examiner*—James W Cranson
(74) *Attorney, Agent, or Firm*—Miles & Stockbridge P.C.

(57) ABSTRACT

A flashlight has a pair of light emitting elements mounted on a pivotable switch actuator to place the light emitting elements in any one of an OFF position, a spot illumination position, and a flood illumination position.

10 Claims, 3 Drawing Sheets

FLASHLIGHT

CROSS REFERENCE TO RELATED APPLICATION

This application takes the benefit of Provisional Application No. 60/361,304 filed Mar. 4, 2002 (incorporated herein by reference).

BACKGROUND OF THE INVENTION

This invention relates to flashlights, and more particularly to flashlights that are capable of projecting spot illumination or flood illumination, selectively. Prior flashlights of this type have employed light emitting elements fixed at different positions relative to a reflector and selectively energized. A need has remained for a flashlight that is capable of providing spot illumination or flood illumination selectively, that is simple and economical to manufacture, and that is easy to use. The present invention satisfies that need.

BRIEF DESCRIPTION OF THE INVENTION

In a preferred embodiment, a flashlight of the present invention employs two bulbs that are moved in unison relative to a reflector among three positions, namely an OFF position in which neither bulb is lit, a spot illumination position in which one of the bulbs is centered on the reflector and is lit, and a flood illumination position in which the bulbs are located symmetrically about the center of the reflector and both are lit. The bulbs are moved by a simple switch actuator that can be operated by a user's thumb.

BRIEF DESCRIPTION OF THE DRAWINGS

The invention will be further described in conjunction with the accompanying drawings, which illustrate a preferred (best mode) embodiment, and wherein.

DETAILED DESCRIPTION OF THE INVENTION

Figure 1:
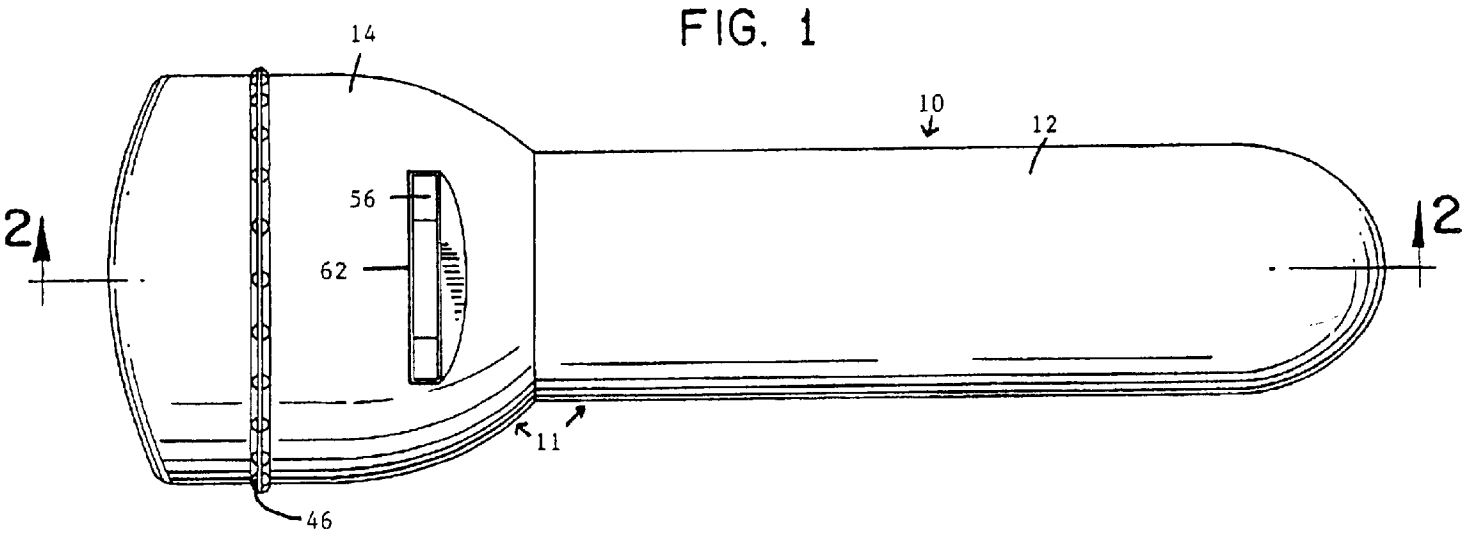
FIG. 1 is a top plan view of the flashlight.
Figure 2:
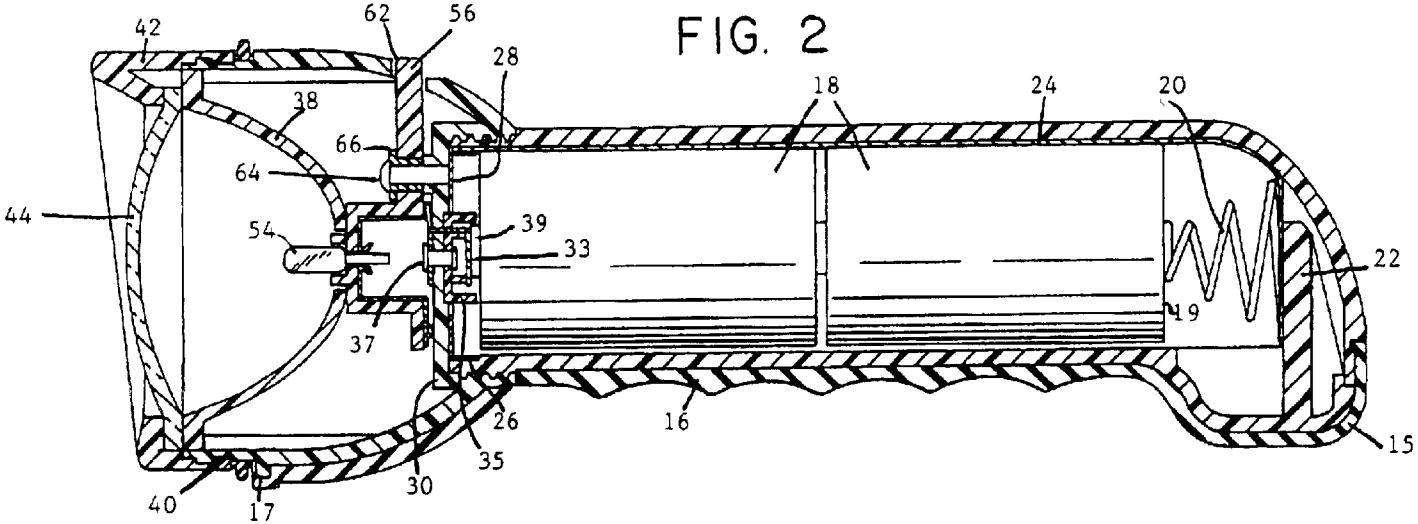
FIG. 2 is longitudinal section taken along line 2—2 in FIG. 1.

As shown in FIGS. 1 and 2, a flashlight 10 in accordance with the invention has a case 11 that includes a barrel 12 and a head 14, both of which may be formed of an appropriate plastic, for example. The lower portion of the case may have a rubber or rubberized insert 16 with finger depressions.

The rear end of the barrel 12 may have a downwardly extending projection 15 with a flattened bottom, and the bottom of the head 14 may have a flat projection 17 (see FIGS. 3–5), so that the flashlight can be supported stably on a horizontal surface.

In the preferred embodiment, the barrel 12 is threaded into the head 14 after two dry-cell batteries 18 (e.g., "D" cells) are inserted into the barrel seriatim. The negative terminal 19 of the rear battery engages one end of a tapered metal coil compression spring 20, the other end of which is mounted on an abutment 22 in the barrel in contact with an end portion of a metal strip 24 that extends along the length of the barrel in a groove. The forward end of the strip 24 engages a circular metal rim 26 mounted on the forward end of the barrel. Rim 26 contacts an annular metal disk 28 mounted on the rear face of an insulating disk 30 that is mounted in the head 14 adjacent to the front of the barrel, forwardly of the threads of the head.

The flashlight of the present invention includes a switch mechanism having fixed electrical contacts and cooperable moveable electrical contacts.

Figure 6:
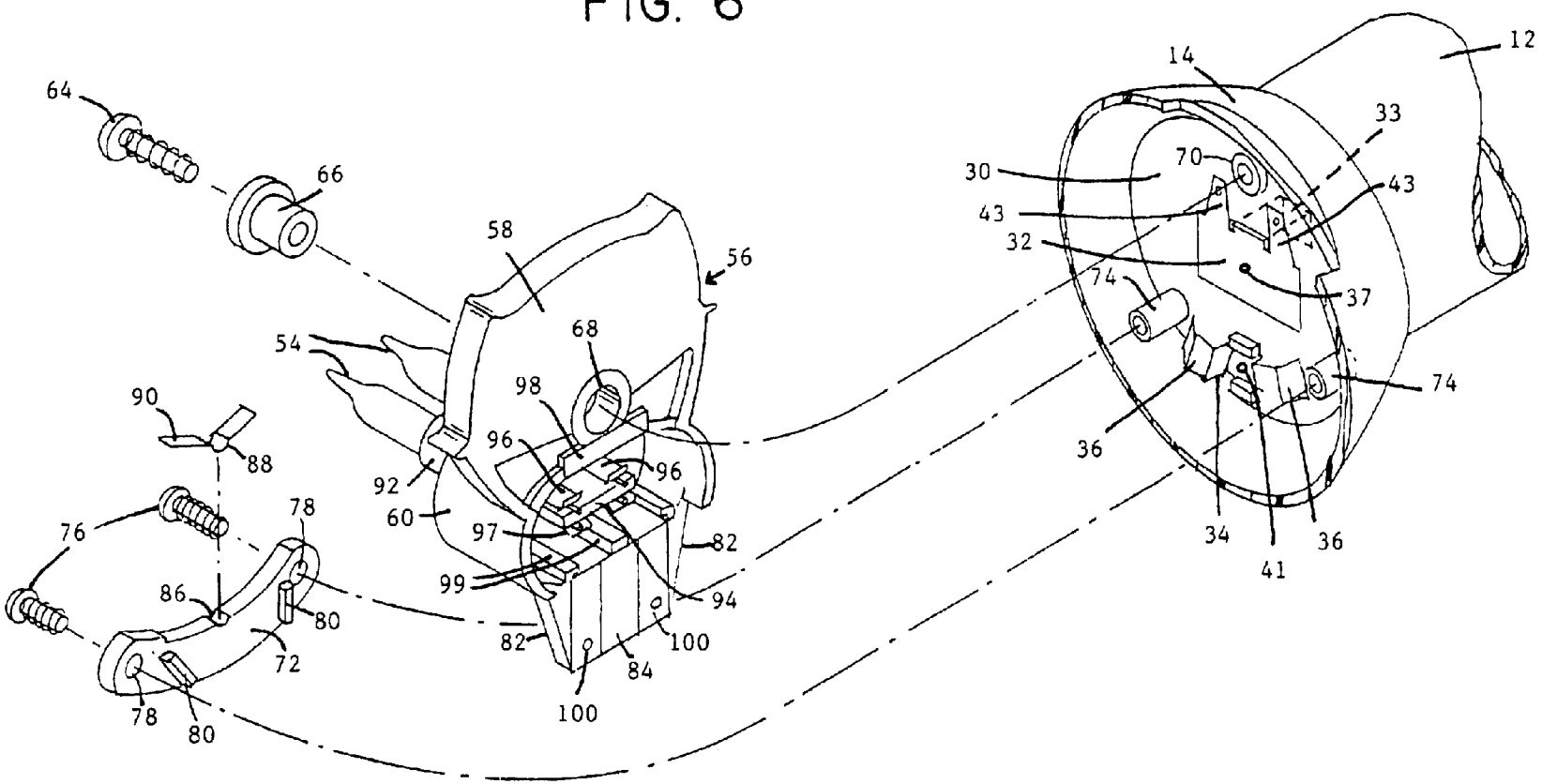
FIG. 6 is a fragmentary exploded view illustrating features of the flashlight.

As shown in FIG. 6, mounted on the front face of the disk 30 is a metal contact strip 32 having a portion 33 that extends rearwardly through the insulating disk 30 and into an insulating cup 35 (see FIG. 2). Contact strip 32 and cup 35 are mounted on the insulating disk 30 by a metal rivet 37. The rear end of portion 33 of the contact strip 32 is turned downwardly to engage the positive terminal 39 of the forward battery. Contact strip 32 has a pair of spaced forwardly slanting leaves 43. Also mounted on the front face of the disk 30, by a metal rivet 41, is a metal contact strip 34 that is electrically connected to the annular metal disk 28 by the rivet. The latter contact strip has two spaced forwardly projecting contact leaves 36.

As shown in FIG. 2, the head 14 supports a metallized plastic reflector 38 (that may be parabolic, for example). The reflector is mounted on a cylindrical front projection 40 of the head by means of small arcuate flanges (not shown) on the periphery of the reflector that enter corresponding slots (not shown) in the cylindrical projection 40. A tapered cylindrical bezel 42 supports a lens 44 and is mounted on the cylindrical projection 40 by bayonet-type joints (not shown), including stepped arcuate slots on the inner surface of the cylindrical projection 40, and corresponding arcuate protuberances on the outer surface of the cylindrical projection 40, which permit the bezel to be pressed onto the cylindrical projection and then turned through a small angle to lock it in place. A decorative ring 46 may be provided between the bezel and a rim of the head 14 that surrounds the rear extremity of the cylindrical projection 40.

Figure 4:
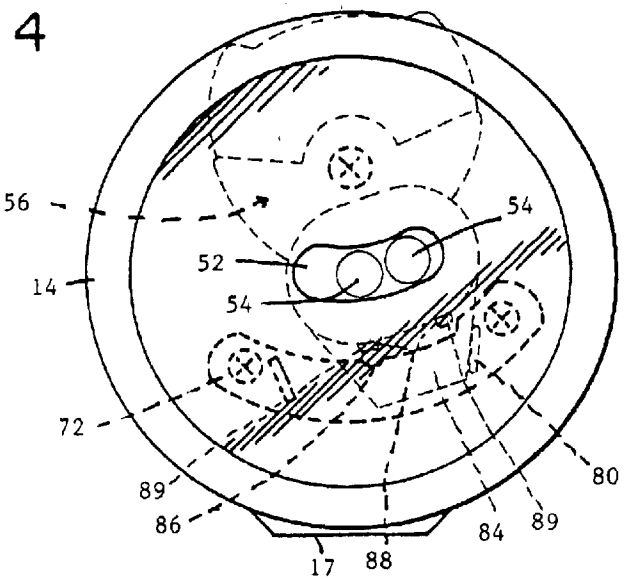
FIG. 4 is a front elevational view of the flashlight illustrating the spot illumination position.
Figure 3:
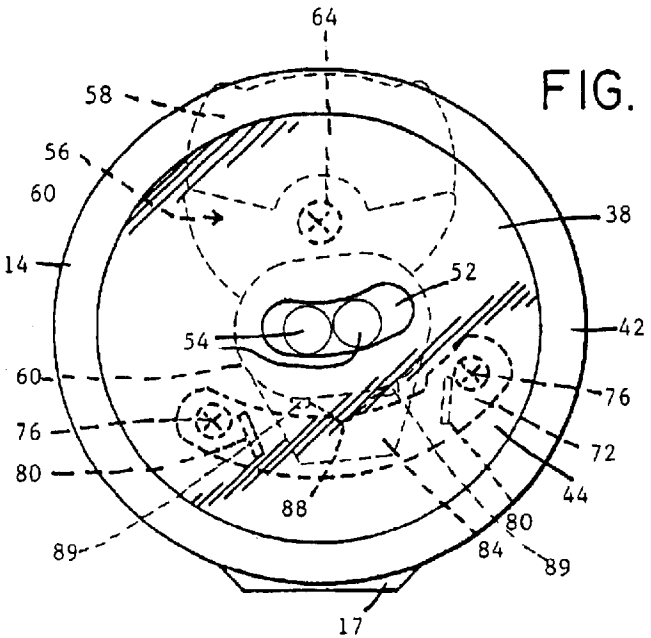
FIG. 3 is a front elevational view of the flashlight illustrating the OFF position.
Figure 5:
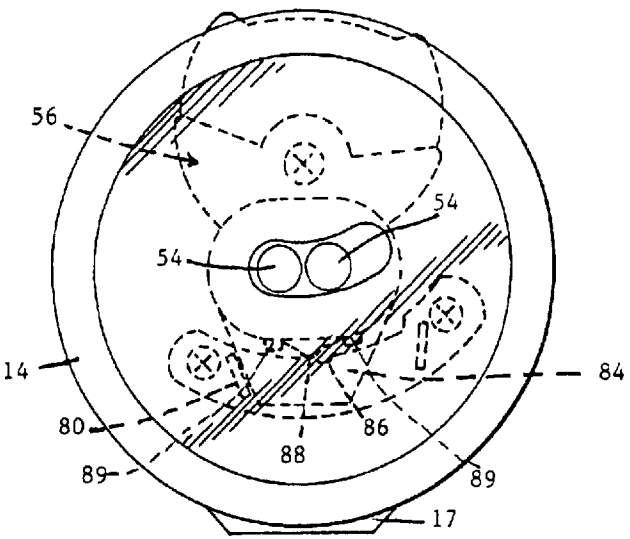
FIG. 5 is a front elevational view of the flashlight illustrating the flood illumination position.

As shown in FIGS. 3–5, the reflector 38 has an arcuate slot 52, disposed asymmetrically on the reflector, through which two light emitting elements 54 project and are exposed. The light emitting elements will be referred to as "bulbs" herein. The bulbs may be incandescent or halogen types, for example. Other types of light emitting elements, such as LED's can be used.

As shown in FIG. 6, the bulbs are mounted on a switch actuator 56 having a plate-like finger-engaging portion 58 at one end and a cup portion 60, between its ends, that is tilted relative to the portion 58 (see FIG. 3). The actuator 56 may be formed of molded plastic, but the portion 58 can be rubberized or formed of rubber material. The portion 58 projects through a slot 62 (FIGS. 1 and 2) in the head 14, and its outer surface is contoured for easy manipulation by a user's thumb.

As shown in FIGS. 3–6, the actuator 56 is pivotally supported on the disk 30 by means of a screw 64 inserted in the bore of a cylindrical plug 66 that, in turn, is inserted in a cylindrical hole 68 in the actuator. The screw is threaded into a protrusion 70 on the insulating disk 30. In the preferred embodiment, pivotal movement of the actuator 56 is about an axis that is parallel to the length of the case 11 of the flashlight and parallel to the axis of the reflector 38. The bulbs 54, being fixed to the switch actuator 56, move along the slot 52 during pivotal movement of the switch actuator.

As shown in FIG. 6, in the preferred embodiment an arcuate plastic piece 72, forming a guide, is mounted on forwardly projecting bosses 74 of the insulating disk 30 by screws 76 that pass through holes 78 in end portions of the piece 72 and are threaded into the bosses. The rear face of the arcuate piece 72 has angulated abutment stops 80 that are disposed to engage corresponding angulated edge surfaces 82 of a plate portion 84 that depends from the cup 60 of the actuator 56 at an end thereof, thereby to provide opposite limits to the pivotal movement of the actuator.

The upper edge of the arcuate piece 72 has a notch 86 that receives a projection 88 of a detent spring 90 that is mounted between abutments 89 on the cup 60 (FIGS. 3–5) at the front face of the plate portion 84. In the OFF position, the projection 88 of the detent spring enters the notch 86, as shown in FIG. 3. In the spot and flood illumination positions, the projection 88 of the detent spring rides on the upper edge of the arcuate piece, as shown in FIGS. 4 and 5, and provides stabilizing limited resistance to the pivotal movement of the actuator.

The bulbs 54 are preferably miniature types having bases inserted in cylindrical bosses 92 (FIG. 6) on the cup 60 and having wire leads that embrace an insulating shelf 94 in the cup 60 and that are held between opposite faces of the shelf and leaf spring contact strips 96 and 97. The contact strips 96 have a common base portion supported in channels (not shown) of the cup and terminate in a common elongated contact 98 at a rear edge of the cup 60. The contact strips 97 have base portions held between channels 99 in the cup 60 and terminate in individual contacts 100 on the rear face of the depending plate portion 84 of the actuator. The contact 98 is positioned to engage corresponding contacts 43 of the contact strip 32 on the disk 30. The contacts 100 are positioned for engagement, selectively, with the contacts 36 of the contact strip 34 on the disk 30. One of the wire leads of each bulb 54 is connected via moveable contact 98, fixed contacts 43 of contact strip 32, and portion 33 of contact strip 32 to a positive battery terminal. A negative battery terminal is connected via strip 24, annular metal disk 28, contact leaves 36, and moveable contacts 100 to the other wire lead of the bulbs (selectively).

When the actuator 56 is in the OFF position shown in FIG. 3, neither of the contacts 100 on the actuator engages one of the contacts 36. Instead, the spaced contacts 100 on the actuator are positioned at opposite sides of one of the contacts 36 (the right contact 36 in FIG. 6). In the spot illumination position shown in FIG. 4, one of the bulbs 54 is centered on the reflector 38, and the corresponding contact 100 on the actuator engages a contact 36. In the flood illumination position shown in FIG. 5, the bulbs are located symmetrically about the center of the reflector, and each contact 100 on the actuator engages a corresponding contact 36.

Thus, simply by manipulation of the actuator 56 by the user's thumb to move the actuator among three positions, the user can easily select OFF (no illumination), spot illumination, or flood illumination. It is apparent that the flashlight of the invention is of simple construction with few parts, so that it can be simply and economically manufactured.

While a preferred embodiment of the invention has been shown and described, it will be apparent to those skilled in the art that this embodiment is merely illustrative of the invention, and that various modifications can be made without departing from the principles and spirit of the invention, the scope of which is defined in the appended claims.

What is claimed is:

1. A flashlight capable of spot illumination or flood illumination selectively, comprising:

a switch mechanism having a moveable switch actuator with electrical contacts thereon cooperable selectively with fixed electrical contacts and having a pair of light emitting elements thereon connected to respective electrical contacts thereon, wherein the switch actuator is moveable among three positions, namely an OFF position in which neither light-emitting element is lit, a spot illumination position in which only one of the light emitting elements is lit, and a flood illumination position in which both of the light emitting elements are lit.

2. A flashlight according to claim 1, further comprising a reflector having a slot through which the light emitting elements are exposed.

3. A flashlight according to claim 2, wherein in the spot illumination position one of the light emitting elements is centered on the reflector, and in the flood illumination position the light emitting elements are disposed at opposite sides, respectively, of the center of the reflector.

4. A flashlight comprising:

a case having a barrel for receiving batteries therein and a head attached to an end of the barrel and having a reflector therein;

a switch mechanism having fixed electrical contacts mounted in the case and having moveable electrical contacts mounted on a switch actuator that is pivotably supported in the case and that has a finger-engaging portion extending through a slot in the head; and a pair of light emitting elements mounted on the actuator and pivotable therewith, wherein the reflector has an arcuate slot through which the light emitting elements are exposed and along which the light emitting elements are moved as the switch actuator is pivoted, wherein each of the light emitting elements is connected to a corresponding moveable contact for lighting that light emitting element when its moveable contact engages a fixed contact, and wherein the switch actuator has three selectable positions, namely an OFF position in which neither light emitting device is lit, a spot-illumination position in which one of the light emitting elements is centered on the reflector and is lit, and a flood illumination position in which the light emitting elements are disposed at opposite sides of the center of the reflector and both are lit.

5. A flashlight according to claim 4, wherein the switch actuator is pivotable about an axis parallel to the length of the case, and wherein the finger-engaging portion and the moveable contacts are at opposite ends of the switch actuator and the light emitting elements are mounted on the switch actuator between the opposite ends thereof.

6. A flashlight according to claim 4, further comprising an arcuate piece fixed in the case adjacent to the switch actuator and cooperating with a detent on the switch actuator for setting the OFF position.

7. A flashlight according to claim 6, wherein the arcuate piece has stops engageable with respective surfaces of the switch actuator to limit the pivotal movement of the switch actuator.

8. A flashlight according to claim 6, wherein the switch actuator has a depending plate portion with moveable contacts on a rear face thereof, and wherein the arcuate piece is disposed adjacent to a front face of the plate portion with the stops thereof projecting rearwardly for engagement with respective edge surfaces of the plate portion, and wherein the detent on the switch actuator rides along the arcuate piece.

9. A flashlight according to claim 4, wherein the fixed contacts are mounted on a front face of an insulating disk supported in the case adjacent to a front portion of the barrel, and the moveable contacts on the switch actuator oppose fixed contacts on the insulating disk.

10. A flashlight according to claim 9, wherein the insulating disk has an annular metal disk on a rear face thereof that engages a metal ring at the front of the barrel and that is connected to fixed contacts selectively engaged by moveable contacts, wherein the barrel has a longitudinal metal strip connected at one end thereof to the metal ring and disposed at an opposite end thereof for engagement with a battery terminal, and wherein a center portion of the rear of the insulating disk has a contact that is disposed to engage an opposite battery terminal and that is electrically connected to a fixed contact disposed to engage a moveable contact.

* * * * *